United States Patent [19]

Holdiman

[11] Patent Number: 4,531,337

[45] Date of Patent: Jul. 30, 1985

[54] DOOR CASEMENT

[76] Inventor: Joseph W. Holdiman, 1095 Arrowhead Dr., Dubuque, Iowa 52001

[21] Appl. No.: 468,046

[22] Filed: Feb. 18, 1983

[51] Int. Cl.[3] ..... E06B 1/04

[52] U.S. Cl. ..... 52/217; 52/213; 49/505

[58] Field of Search ..... 49/505; 52/211, 213, 52/217

[56] References Cited

U.S. PATENT DOCUMENTS

| | | | |
|---|---|---|---|
| 1,048,988 | 12/1912 | Mayo | 52/217 |
| 2,826,282 | 3/1958 | Goldberg | 49/505 |
| 2,960,734 | 11/1960 | Collins | 52/217 |
| 3,416,271 | 12/1968 | Heeney | 52/217 |
| 3,451,168 | 6/1969 | Pengelly | 49/505 |
| 4,430,830 | 2/1984 | Sailor | 52/211 |
| 4,432,163 | 2/1984 | Cassiere | 52/217 |

*Primary Examiner*—Henry E. Raduazo

*Attorney, Agent, or Firm*—O'Neill & Bockelman

[57] ABSTRACT

A preassembled door casement adapted to be received within an opening of a wall of selected thickness is provided with a positionable nailing fin about the assembly for securing the assembly to the opening. The position of the nailing fin with respect to the casement is selectable so as to accommodate the particular wall thickness.

5 Claims, 3 Drawing Figures

FIG. 1
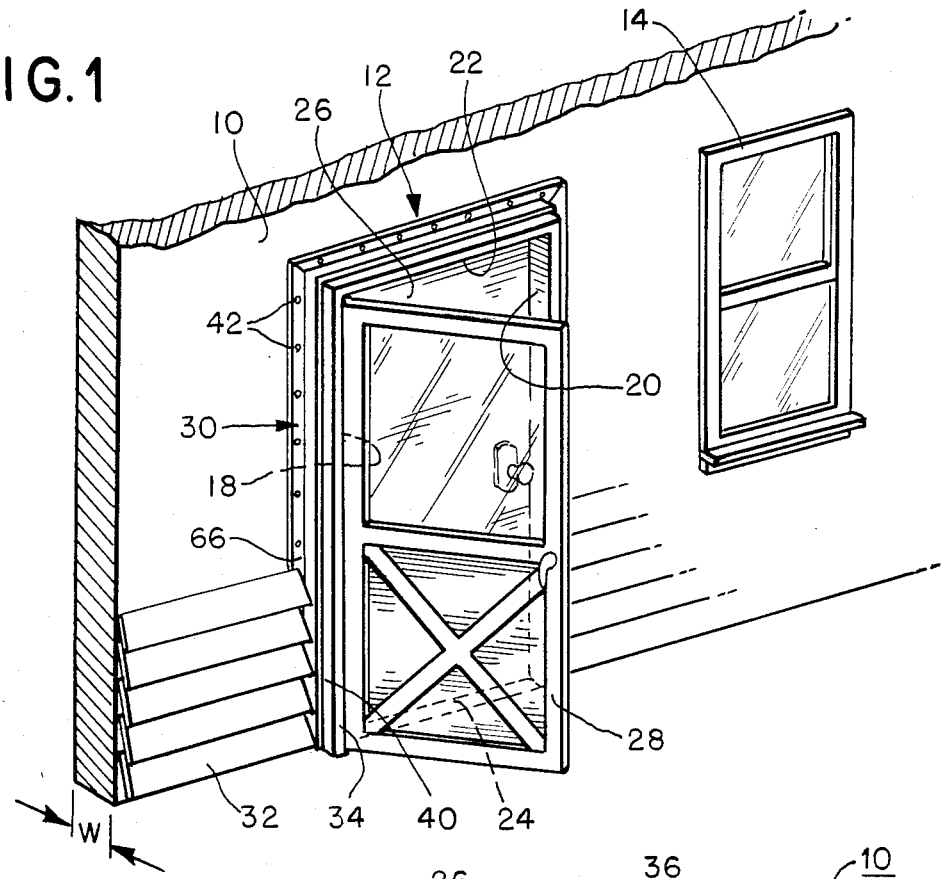
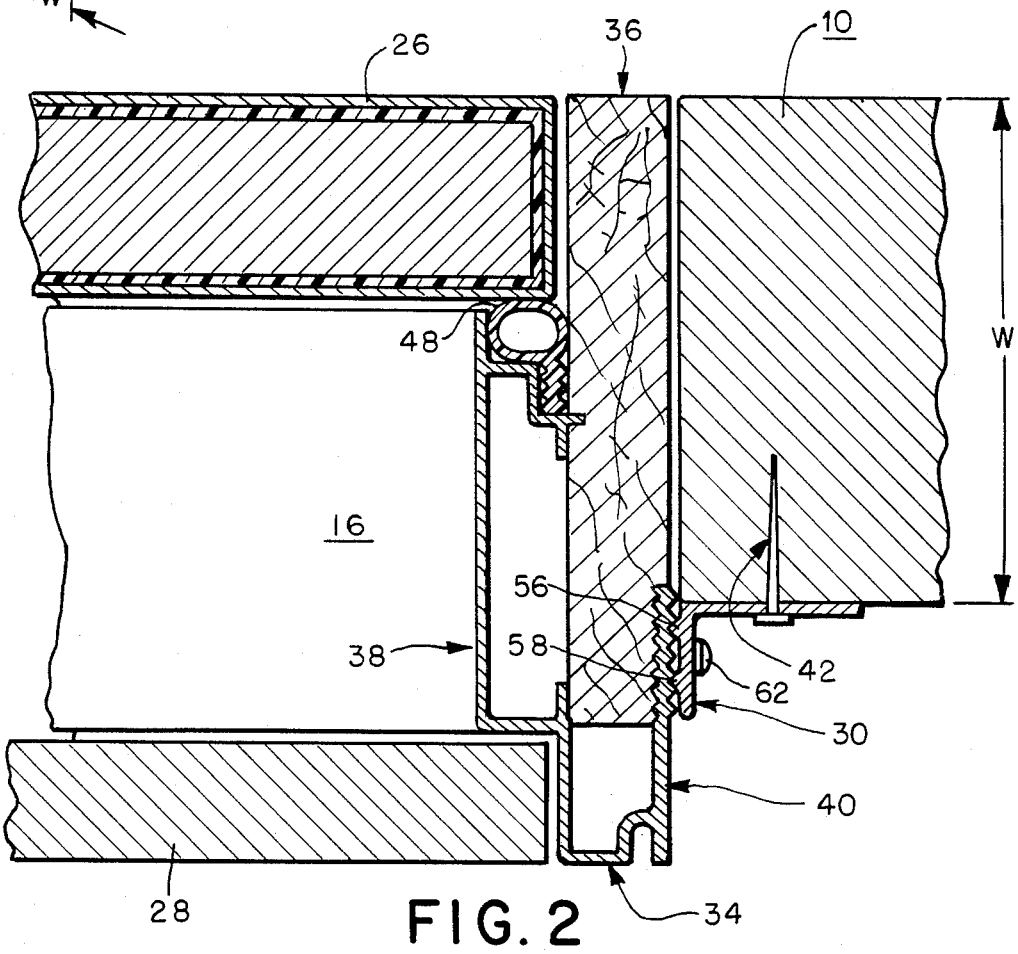
FIG. 2

DOOR CASEMENT

BACKGROUND

This invention relates to a door frame assembly, generally, and more particularly to a door casement for a prehung steel door employed in residential construction.

Several methods exist for securing a door frame having a metal frame and a composite wooden member to an opening. One method is simply to drive fasteners through the side of the wooden member into the opening and to thereafter repair, cosmetically, the recesses formed by the nails. Another method is described in the U.S. Pat. No. 4,330,972, to Sailor issued May 25, 1982, and includes a door casement attached by screws turned through an anchor flange of the metal frame into the door jambs and the header. The screws are then covered with a decorative strip which snaps into a channel along the outer edge of the door jambs and header to cover the anchors and screws.

The methods described above are not suitable in various instances. For example, the filling of nail recesses is time consuming and renders the wood unattractive. The anchor system taught by Sailor, U.S. Pat. No. 4,330,972, is more suited for replacement doors or retro fitting work, and the casement assembly itself has to be preselected and made to fit into an opening of the known width.

Considering the above, I have developed a door casement for a prehung door, which casement is provided with an outer metal member particularly suited for receiving a steel door. Means are provided to overcome the drawbacks of the prior art so that the door casement can fit into an opening wherein the wall thickness varies from jobsite to jobsite thus permitting the construction of the single door for accommodating walls of various thicknesses.

SUMMARY

A door assembly of adjustable width for insertion into a door opening in a wall of selected thicknesses is provided. The assembly has a metal outer frame with a front frace, an inner face, and an outer face. A wooden inner frame member is coupled to the metal outer frame to provide the assembly. Side by side channels form rib means around the outer frame member for receiving a nailing fin. The nailing fin is provided with spaced apart tonges which are received within the ribs of the metal outer frame. The nailing fin is secured to the assembly as well as around the perimeter of the door opening. The position of the nailing fin with respect to the door assembly accommodate various wall widths.

Accordingly, it is a feature of the present invention to provide a preassembled door frame for insertion into a door opening of a wall of a selected thickness wherein the frame is capable of accommodating various wall thicknesses.

Yet another feature of the present invention is to provide a door frame having means for receiving a nailing fin, which nailing fin when attached to the door opening permanently secures the assembly to the existing wall.

Another feature of the present invention is to provide a preassembled door frame having a metal outer frame which may be suitably attached to the existing wall without providing for nails through wooden members of the assembly as well as decorative strips around the perimeter of the frame.

These and other features of the present invention will be better understood by referring to the drawing in which:

DRAWING

FIG. 1 is a perspective view of the door frame assembly inserted into a door opening within a wall of thickness W.

FIG. 2 is a cross-sectional view of the assembly forming the left and right side as well as the header portion thereof.

DETAILED DESCRIPTION

Figure 3:
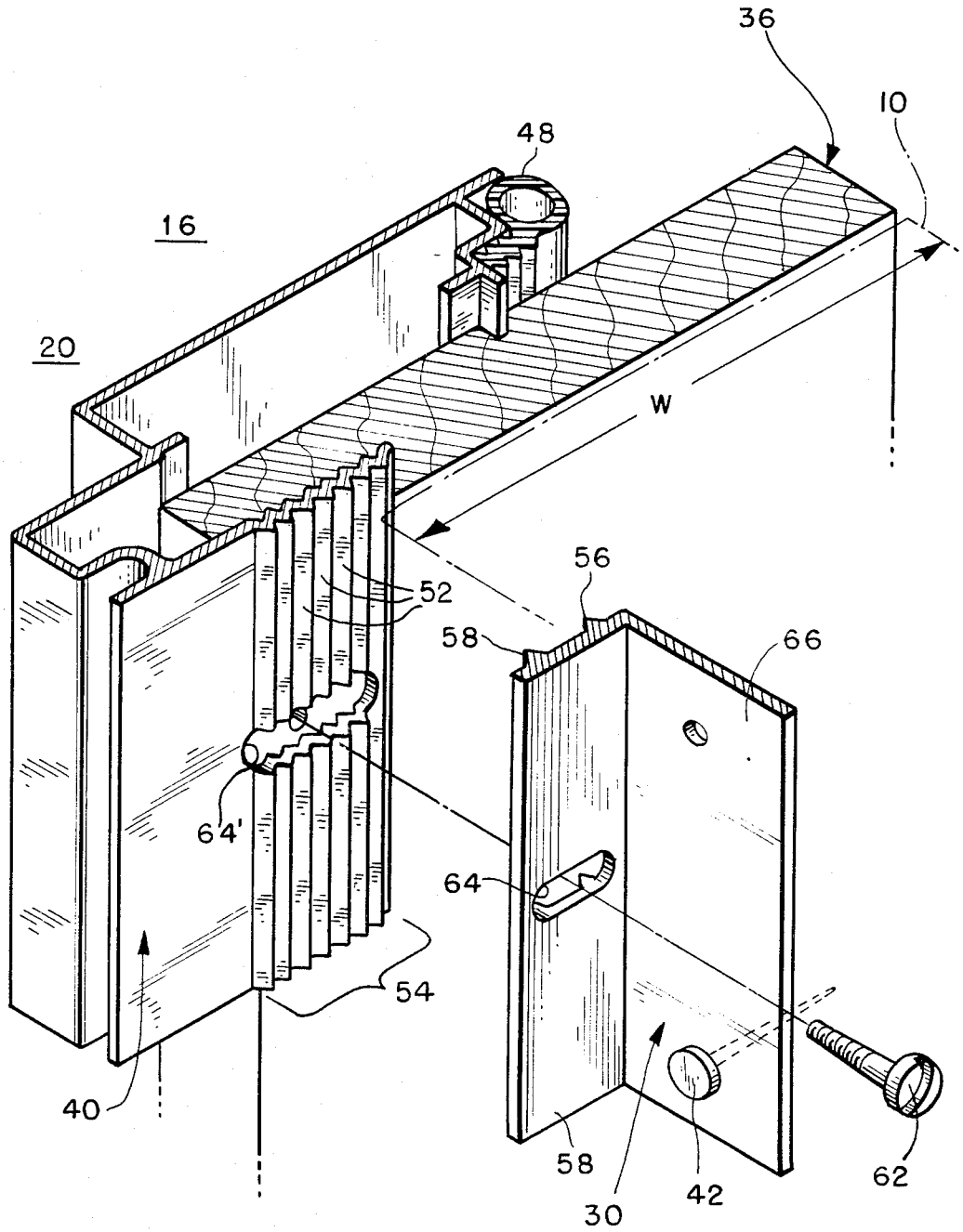
FIG. 3. is an exploded perspective view partly in cross-section, of the assembly and the nailing fin for attaching the assembly to the door opening.

Referring to FIG. 1, the exterior wall of an existing structure 10, as for example residential construction, is shown having a rough opening 12 of selected width W and a window 14.

Generally the width W of wall 10 is $4\frac{1}{2}$ inches, however, it is not uncommon to find variations in the wall thickness of up to $7\frac{1}{2}$ inches from jobsite to jobsite depending upon many factors such as the type of inner and outer wall covering employed during construction.

Although the specifically described preferred embodiment describes preferred form of the invention, it is to be understood that other configurations of it are well within its scope. For example, the preferred embodiment contemplates a door assembly for a metal exterior door for residential construction having provisions for a screen or a storm door. It is clear that the assembly as disclosed is perfectly suitable for interior applications, wooden doors, or even commercial construction.

Returning now to FIG. 1, door casement assembly 16 includes a right vertical side member 18, a left vertical side member 20, header 22, and threshold 24. Side members 18 and 20 and header 24 are of indentical cross-sectional configuration, as will be described in detail below. Steel door 26 is hinged to swing inwardly and is secured to the door casement assembly 16 in a conventional manner. Optional screen or storm door 28 is hinged to swing outwardly in the well-known manner. The casement assembly 16 is secured to the exterior (outer surface) of wall 10 by nailing fin 30, in a manner to be described. Thereafter, exterior siding 32, or the like, may be applied to the outer surface of wall 10 to cover the nailing fin 30.

Turning now to FIG. 2, door casement assembly 16 with steel and screen door 26 and 28, respectively, are shown. The casement assembly 16 has a metal outer frame (which may be a metal extrustion) including front face 34, and an inner wooden frame member 46 coupled to the metal outer frame and having a rear surface 36 inner surface 38 and outer surface 40. Note that the rear surface 36 is flush or co-planar with the interior (inner) surface of wall 10. The casement 16 is attached by nails (or screws) 42 through the rigid nailing fin 30 to the outer surface of wall 10 along the left side 18, right side 20, and header 20 of the door assembly 16 as best seen by reviewing FIG. 1 in conjunction with FIG. 2.

The door casement assembly 16 includes a recess for receiving resilient weather stripping 48.

Referring to FIG. 3, right side member 20 is shown. The outer surface 40 is provided with a plurality of tongue receiving slots 52 in side-by-side relationship, the plurality of which form ribs 54. Ribs 54 extend not only along the length of right side member 20 but also along the left side member 18 and header 22.

Nailing fin 30, having a length substantially equal to the length of right side member 20, has protrusions or tongues 56 and 58 extending outwardly from the fin base portion 60. The height and width of the tongues 56 and 58, as well as the distance therebetween, are selected so that tongues 56 and 58 are received within slots 52 forming ribs 54. The nailing fin 30 is secured to the door casement assembly by screws 62 retained by inner wooden member 46 and inserted through openings 64 and 64' thereby capturing the nailing fin 30 therebetween. Holes 64 may be suitably placed along each side member and header member as required.

It is apparent that prior to securing nailing fin 30 to door casement 16 by screws 62 one may select the appropriate lateral position of nailing fin 30, in that tongues 56 and 58 may be received in ribs 54 at a selected distance W from rear face 36. Since the width W varies from job to job the tradesman can laterally position the nailing fin 30 so that lip 66 of the fin lies flat against the outside portion of the exterior wall.

Typically, ribs 54 in cooperation with the nailing fin 30 provide for the lateral movement of the fin toward or away from rear surface 36. If the fin is turned upside down (that is the fin base portion 60 is to the right of lip 66 as shown in FIG. 3) additional lateral movement is realized.

I claim:

1. A door assembly of adjustable width for insertion into a door opening in a wall of selected thickness having inner and outer surfaces, comprising:

a metal outer frame having a front face and inner and outer surfaces;

a wooden inner frame member coupled to said metal outer frame and having a rear surface, said rear surface of said wooden frame member being substantially coo-planar with the inner surface of said wall;

rib means disposed around the outer surface of said metal outer frame for receiving a nailing fin;

a nailing fin having tongue means to be received within said rib means, said rib means and said tongue means cooperating to provide an adjustable distance between said nailing fin and said front face; and fastener means extending through said nailing fin and into said wooden inner frame member for capturing said tongue means within said rib means.

2. In a pre-assembled door frame assembly for insertion into a door opening within a wall of a selected thickness, said assembly having a metal outer frame to form at least two sides and a header, said metal outer frame having an inner surface and an outer surface adapted to abut the door opening, the improvement comprising:

means for securing said assembly to said door opening along said two sides and said header including:

a plurality of slots located on the outer surface of said metal outer frame along said two sides and said header;

a nailing fin having at least two spaced apart tongues of sufficient size and spacing to be received within selected ones of said plurality of slots, said nailing fin being adjustably positioned with respect to said metal outer frame in response to receipt of said tongues in different selected ones of said plurality of slots;

fastener means extending through said nailing fin and into said two sides and said header for causing the capturing of and retaining said tongues within said selected ones of said plurality of slots; and means for securing said nailing fin to said door opening.

3. The preassembled door assembly of claim 2 wherein said tongue traverses the length of the fin.

4. The preassembled door assembly of claim 2 wherein said tongues may be selectively positioned in said slots to accommodate the width of said selected wall thickness.

5. The preassembled door assembly of claim 2 wherein said slots are integrally formed with said metal outer frame and said metal outer frame is a metal extrusion.

* * * * *